United States Patent [19]

Shirey

[11] 4,387,662

[45] Jun. 14, 1983

[54] CORRUGATED PIPE ADHESIVE APPLICATOR APPARATUS

[75] Inventor: Ray A. Shirey, North Grafton, Mass.

[73] Assignee: Westinghouse Electric Corp., Pittsburgh, Pa.

[21] Appl. No.: 354,486

[22] Filed: Mar. 3, 1982

[51] Int. Cl.[3] ..... B05C 7/08

[52] U.S. Cl. ..... 118/105; 118/108; 118/110; 118/213; 118/254; 118/DIG. 10; 118/306

[58] Field of Search ..... 118/105, 254, DIG. 10, 118/306, 213, 207, 215, 504, 408, 258, 108, 110; 427/230, 239, 428, 282

[56] References Cited

U.S. PATENT DOCUMENTS 2,133,035 10/1938 Morain ..... 118/105

2,484,018 10/1949 Crom ..... 118/306 X

*Primary Examiner*—John P. McIntosh

*Assistant Examiner*—Mary Beth Calligaris

*Attorney, Agent, or Firm*—M. S. Yatsko

[57] ABSTRACT

Apparatus for coating selected portions of the troughs of a corrugated pipe within an adhesive includes a support disposed within the pipe with a reservoir containing the adhesive disposed on the support. A pump, including a spout, is utilized for supplying the adhesive from the reservoir to a trough of the pipe. A rotatable applicator is supported on the support and contacts the trough of the pipe. The applicator itself is sized so as to fit within the trough, and contacts the adhesive in the trough and spreads the adhesive in the trough upon rotation. A trough shield, supported by the support and disposed in the path of rotation of the applicator, is utilized to prevent the applicator from contacting selected portions of the trough. A locator head is also disposed on the support and provides a way for aligning the spout, the applicator, and the trough shield with the trough.

10 Claims, 4 Drawing Figures

CORRUGATED PIPE ADHESIVE APPLICATOR APPARATUS

GOVERNMENT CONTRACT

The Government has rights in this invention pursuant to Contract No. DE-AC01-78-ET-29046 awarded by the United States Department of Energy.

BACKGROUND OF THE INVENTION

This invention relates generally to coating apparatus, and more particularly to an adhesive particle trap applicator apparatus for depositing an adhesive in the troughs of the corrugated sheath of a compressed gas-insulated transmission line.

Compressed gas-insulated transmission lines are being increasingly utilized to transmit large magnitudes of electrical energy. Typical gas-insulated transmission lines include a cylindrical rigid outer sheath typically at ground potential and a high-voltage inner conductor disposed within the outer sheath. An insulating gas, such as sulfur hexachloride, is utilized inside the outer sheath to electrically insulate the inner conductor from the outer sheath. Insulating supports are utilized at spaced intervals along the length of the transmission line to insulatably support the inner conductor within the outer sheath. Particle traps, used to deactivate contamination particles within the line, are typically disposed at spaced intervals along the length of the transmission line.

One disadvantage with the typical gas-insulated transmission lines is that the lines themselves are rigid; they cannot be significantly bent or turned to accommodate changes in direction or to avoid unforeseen obstacles within their path. All changes of direction in a transmission line must therefore be typically accomplished through the use of elbows or junction boxes or the like. To overcome this drawback, a new type of gas-insulated transmission line is being investigated. The new type of transmission line utilizes a corrugated outer sheath and a flexible inner conductor which provide flexibility in the transmission line. This flexibility can then be utilized to facilitate changes of direction.

One obstacle to the manufacture of this new type semi-flexible gas-insulated transmission line concerns contamination particles which may be disposed within the outer sheath, and which may cause a premature breakdown of a transmission line. In the rigid outer sheath systems, particle traps were placed at spaced intervals along the length of the transmission line. Contamination particles present within the line, following an application of a lowered voltage, would tend to migrate longitudinally along the transmission line until they became trapped in the particle traps. They then were effectively prohibited from affecting operation of the transmission line. However, with the corrugated outer sheath of the new semiflexible transmission lines, the particles are unable to easily migrate the length of the lines. As a consequence, these particles are not readily trapped within the particle traps, and are thus free to cause premature breakdown of the system.

One method for immobilizing the contamination particles in the corrugated outer sheath is to utilize an adhesive material to physically capture the particles within the outer sheath and thus prevent them from obtaining the mobility to initiate breakdowns. The most desirable location to apply the adhesive in the troughs, or low spots, in the bottom portion of the transmission line, where the electric field is lower than on the crowns of the corrugations. Some apparatus must then be utilized to apply this adhesive only in the troughs of the corrugations of the outer sheath of the transmission line, and this apparatus must be capable of being utilized along the entire length of each corrugated outer sheath section, which may extend for 30 feet or more.

SUMMARY OF THE INVENTION

In accordance with this invention, apparatus for coating selected portions of the troughs of a corrugated pipe with an adhesive comprises a support disposed within the pipe with a reservoir containing the adhesive disposed on the support. A pump, including a spout, is utilized for supplying the adhesive from the reservoir to a trough of the pipe. A rotatable applicator is supported on the support and contacts the trough of the pipe. The applicator itself is sized so as to fit within the trough, and contacts the adhesive in the trough and spreads the adhesive in the trough upon rotation. A trough shield, supported by the support and disposed in the path of rotation of the applicator, is utilized to prevent the applicator from contacting selected portions of the trough, namely the upper 240 degrees. A locator head is also disposed on the support and provides a way for aligning the spout, the applicator, and the trough shield with the trough.

BRIEF DESCRIPTION OF THE DRAWINGS

Reference is now made to the description of the preferred embodiment, illustrated in the accompanying drawings, in which.

DESCRIPTION OF THE PREFERRED EMBODIMENTS

Figure 1:
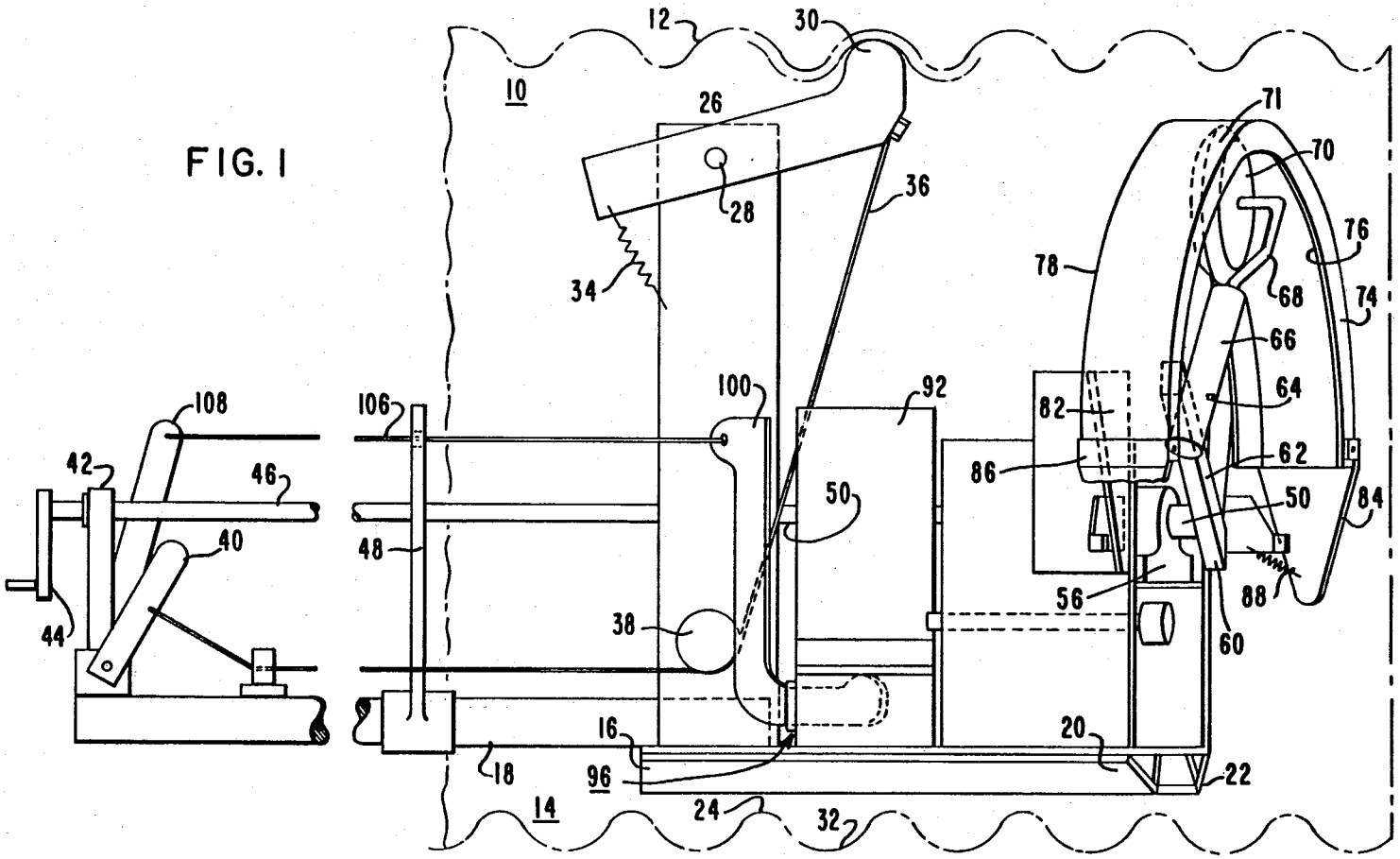
FIG. 1 is a longitudinal, elevational view illustrating the apparatus of this invention.
Figure 2:
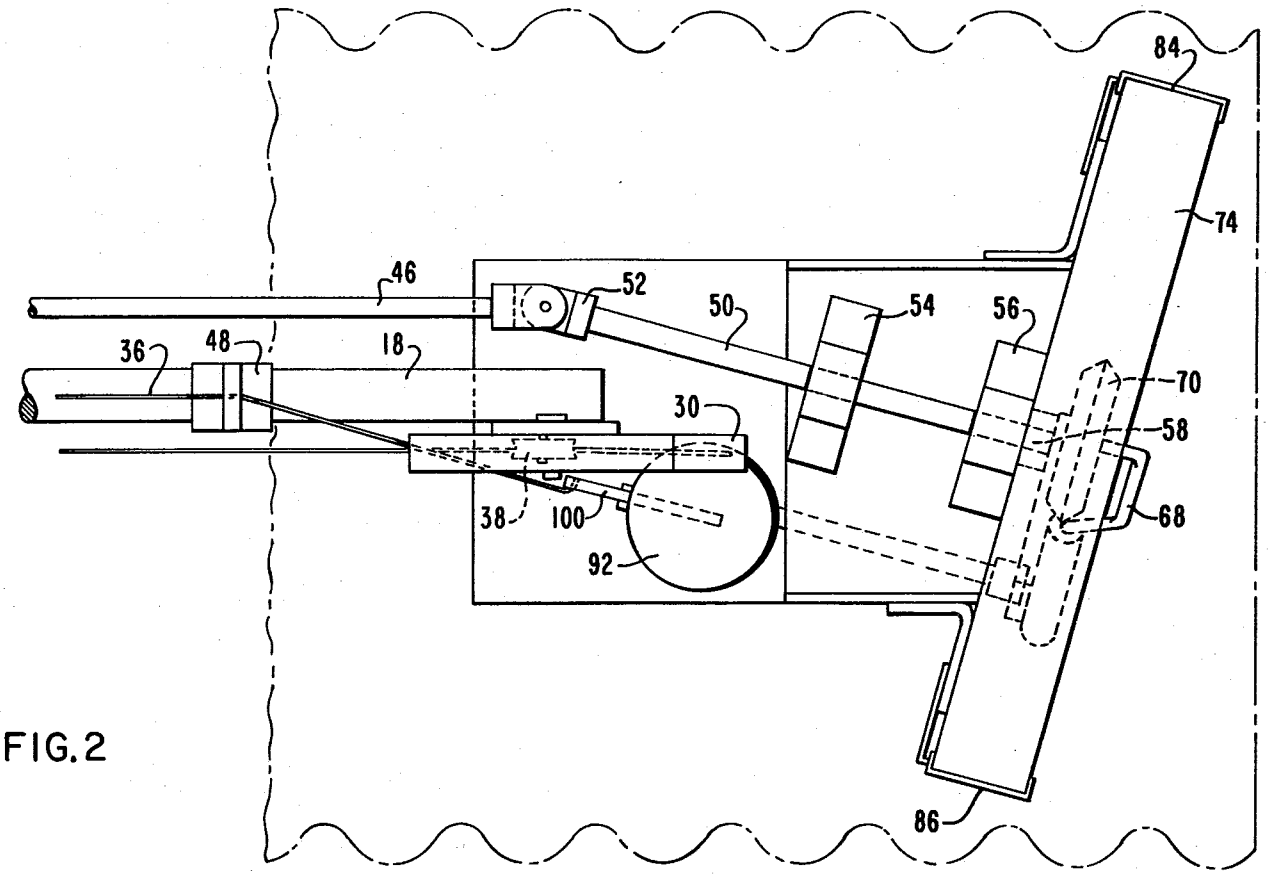
FIG. 2 is a plan view of the apparatus illustrated in FIG. 1.
Figure 3:
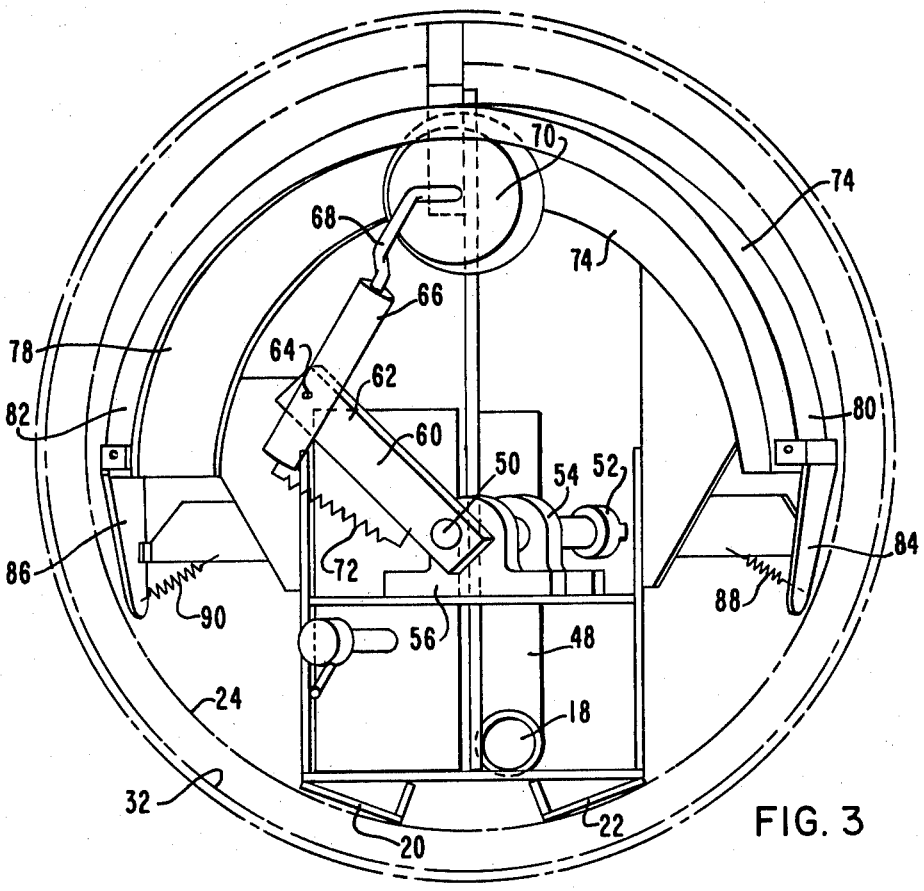
FIG. 3 is an end view, in elevation, illustrating the apparatus of this invention.

Referring now more particularly to FIGS. 1, 2 and 3, therein is illustrated the adhesive applicator apparatus 10 according to the teachings of this invention. As can be seen, the apparatus 10 is disposed within a corrugated pipe 12 which would be the outer sheath of a semi-flexible gas-insulated transmission line. Although the corrugated sheath, or pipe 12, is illustrated as being spirally wound, the invention is also applicable to apply adhesive to corrugated pipes which are annularly wound. The applicator apparatus 10 is comprised of a support 14 which is formed from a support base 16 and a longitudinally extending aluminum tube support extension 18 fixedly secured to the support base 16. The support base 16, as illustrated, is disposed within the pipe 12 and rests on a pair of spaced-apart slides 20, 22 (see FIG. 3). The slides 20, 22 rest upon the crowns 24 of the pipe 12, and are made of a low-friction material such as ultra-high molecular weight polyethylene. The use of the polyethylene slide is to prevent the generation of metallic particles as the support base 16 is slid along the interior of the pipe 12. The support extension 18 is utilized for moving the support base 16 inside the pipe 12, as the pipe 12 may be a section extending up to 30 feet in length or more.

Secured to the support base 16 is a locator support bracket 26, and pivotally mounted to the support bracket 26, by means such as the pin 28, is a locator head 30. The locator head 30 is shaped to fit longitudinally within one of the troughs 32 of the pipe 12, and is biased, by means such as the spring 34, against the pipe 12. The locator head 30 is utilized for aligning the applicator apparatus 12 with the troughs 32 of the pipe 12, in a manner which will be hereinafter explained in greater detail.

Secured to the locator head 30 is the locator cable 36, which extends around the pulley 38 secured to the support bracket 26, and which extends along the length of the support extension 18 to where it is secured to the lever 40, which lever is supported on the support extension 18. Movement of the lever 40 to the left as illustrated in the drawings causes a movement of the locator head 30 away from the corrugated pipe 12, and enables the locator head 30 to be moved longitudinally within the pipe 12 without having the locator head 30 engage the pipe 12.

Also supported on the support extension 18 outside the pipe 12 is the crank bracket 42 which rotatably supports the manual crank 44. (Although illustrated as a manual crank, the apparatus may also be driven by an electric motor, for example). The crank 44 is fixedly secured to the rigid drive shaft 46, which is supported by both the crank bracket 42 and the intermediate support bracket 48 so as to allow rotation of the first drive shaft 46. The drive shaft 46, in turn, is fixedly connected to the drive shaft 50 through the "U"-joint 52 (FIG. 2). In this manner, rotation of the crank 44 causes a corresponding rotation of the drive shaft 46 and the drive shaft 50. The drive shaft 50 is rotatably supported on the support base 16, and is disposed specifically within the pillow bearings 54, 56. The end 58 of the drive shaft 50 extends outwardly beyond the longitudinal end of the support base 16.

Fixedly secured to the end 58 of the drive shaft 50 is the bracket member 60. The bracket member 60, at an end 62 distal from the fixed connection to the drive shaft 50, has a pin 64 extending outwardly therefrom, and pivotally mounted on the pin 64 is the applicator support 66. Fixedly secured to the applicator support 66 is an applicator holder 68 which, in turn, is rotatably secured to the applicator 70. The applicator support 66 is biased, by means such as the spring 72, in the direction of the pipe 12, so that the applicator 70, because of the biasing action of the spring 72, rests against the interior of the pipe 12.

The applicator 70 is made of a flexible material such as polypropylene felt, and has a tapered end section 71 contacting the pipe trough 32.

Operation of the apparatus 10 proceeds as follows: rotation of the crank 44 in, for example, a counterclockwise rotation as shown in FIG. 3 causes a corresponding counterclockwise rotation of both drive shafts 46, 50. Rotation of the drive shaft 50 causes a corresponding rotation of the bracket member 60 secured thereto, and likewise causes a counterclockwise rotation of the applicator support 66, the applicator holder 68, and the applicator 70 itself. The applicator 70 is aligned with one of the troughs 32 of the pipe 12, and during its rotation about the drive shaft 50, the applicator will be disposed within the trough 32 at least for the bottommost 120 degree circumferential arc thereof.

Also supported by the support base 16 is the trough shield 74. The trough shield 74 has a longitudinal width slightly larger than the longitudinal width of the troughs 32 of the pipe 12, and has front and rear overhanging lips 76, 78 respectively. The trough shield 74 is disposed in the path of rotation of the applicator 70 and is spaced apart from the pipe 12. The trough shield 74 serves to prevent the applicator 70 from spreading the adhesive in the upper portions of the trough 32, where in gas-insulated transmission lines it is desired that there be no such adhesive deposition, and further functions to prevent the adhesive from being applied to the crown portions 24 of the corrugations in spirally corrugated pipe where the rotation of the applicator 70 would contact such crowns 24.

The trough shield 74 has, at its circumferential ends 80, 82, a pair of ramps 84, 86 respectively which are biased radially inwardly by the springs 88, 90. The ramps 84, 86 enable the applicator 70, as it rotates, to rise from the troughs 32 onto the trough shield 74 and conversely, to return from the trough shield 74 to the trough 32. As the applicator 70 rotates in, for example, the counterclockwise direction as illustrated in FIG. 3, the applicator 70 will hit the ramp 84 and exert a countervailing force against it to force the ramp 84 outwardly to the pipe 12. The applicator 70 then, upon continued rotation, would roll off the trough 32 onto the ramp 84 and thence onto the trough shield 74. Continued rotation of the applicator 70 would result in the applicator 70 hitting the ramp 86, forcing it outwardly to the pipe 12 with the result that the applicator 70 would then roll off the ramp 86 and the trough shield 74 into the trough 32, where it would then continue applying the adhesive.

Disposed on the support base 16 is a reservoir 92 (see also FIG. 4) which contains a quantity of the adhesive 94. The adhesive 94 may be, for example, the permanently sticky gluelike substance sold under the trade name Pliobond 5000. The reservoir 92 is connected to a pump means 96 which includes the spout 98 aligned with the trough 32 when the applicator apparatus 10 is in position, as determined by the locator head 30, and pump means 96 is utilized for supplying the adhesive 94 from the reservoir 92 to the spout 98.

Figure 4:
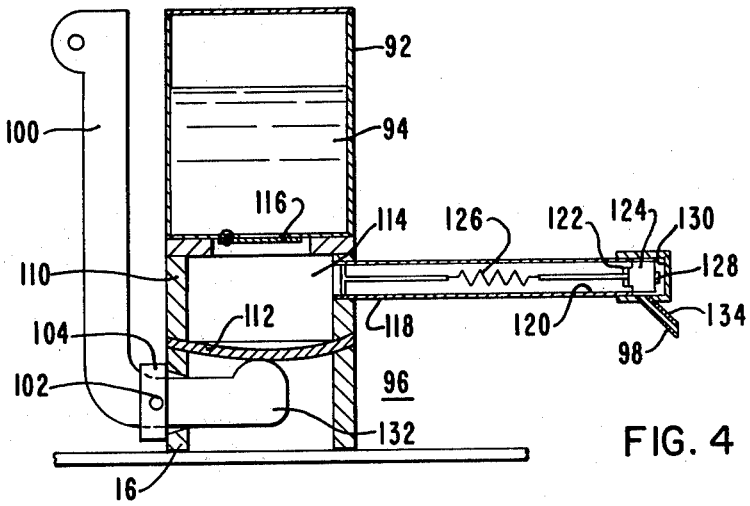
FIG. 4 is a detailed view of the pump means utilized in the apparatus.

The pump means 96, as illustrated in FIG. 4, comprises a lever 100 pivotally secured, by means such as the pivot bolt 102 to an extension 104 of the support base 16. The lever 100 is connected to a cable 106 which, in turn, is secured to a lever 108 mounted on the end of the support extension 18 adjacent the locator lever 40. The lever 100 thus can be operated from the end of the apparatus externally of the pipe 12, and can be operated from the same location as the locator head 30 and the crank 44.

The pump means 96 further comprises the cylindrical structure 110 which is part of the support base 16, with a flexible diaphragm 112 being disposed at the bottom of the cylindrical structure 110. Thus, a cavity 114 is formed. A one-way check valve 116 is disposed in the bottom of the reservoir 92, and opens into the cavity 114. A pipe 118, having a longitudinally extending opening 120 therein, also opens into the cavity 114, and has disposed at the longitudinally extending end 122 thereof a second one-way check valve 124. The check valve 124 allows the adhesive to flow into the spout 98 and thus to the trough 32. A spring 126 is utilized within the opening 120 of the pipe 118 to apply a bias to the check valve 124 to minimize the amount of adhesive which can leak through the check valve 124 when the pump handle 100 is not being activated. The check valve 124 has a tip 128 at the end thereof which contacts the end wall 130 of the valve structure to minimize the amount of adhesive 94 which can accumulate between the valve 124 and the wall 130, while at the same time not causing the valve 124 to adhere to the wall 130.

Operation of the pump means 96 is initiated by moving the lever 108 in, as shown in the drawings, a direction to the left. This movement causes the cable 106 to likewise move to the left, resulting in a pivotal movement of the lever 100 about the pivot bolt 102. The actuating portion 132 of lever 100 contacts the bottom portion of the diaphragm 112, causing it to move upward and to cause a pumping action in the cavity 114. This pumping action initially causes any air present within the cavity 114 to travel through the opening 120 in the pipe 118 and moves the check valve 124 to its right farthermost location, thereby causing the air to be expelled out the spout 98.

After the air present within the cavity 114 has been expelled, the check valve 116 at the bottom of the reservoir 92 allows the adhesive 94 disposed therein to enter into the cavity 114, where further pumping action by the activator portion 132 of the lever 100 causes the adhesive to likewise enter into the opening 120 in the pipe 118, to traverse through this opening 120 to against the check valve 124 and thence into the opening 134 of the spout 98. The adhesive 94 then falls from the spout 98 into the trough 32 of the pipe 12. The adhesive 94 falls into the trough 32 because the spout 98 is aligned with the trough 32 by means of the locator head 30.

The operation of the adhesive applicator apparatus 10 proceeds as follows. The pipe 12 is secured, and the support base 16 is slid into the pipe 12 the farthermost distance it can go while still maintaining the crank 44 and the levers 40, 108 externally of the pipe 12. While the support base 16 is being inserted into the pipe 12, the lever 40 is actuated so as to draw the locator head 30 downwardly away from the pipe 12 so that the locator head 30 does not contact the corrugated pipe 12.

Once the support base 16 is in its approximate location, the locator head lever 40 is released, thereby releasing the locator head 30 so that it contacts the pipe 12. The support base 16 is then longitudinally moved, by means of the support extension 18, until such time as the locator head 30 is disposed within a trough 32. When the locator head 30 is disposed within a trough 32, the spout 98, the applicator 70, and the trough shield 74 are all aligned with another trough 32 of the pipe 12.

Once the support base 16 is thus located, the pump lever 108 is actuated, as previously described, and supplies a quantity of adhesive 94 from the reservoir 92 to the spout 98, from whence it falls into the bottom of the trough 32 and forms a puddle therein. After a sufficient amount of adhesive 94 has been supplied to the trough 32, the crank 44 is rotated, causing a corresponding rotation of the applicator 70. As the applicator 70 rotates, it traverses trough the puddle (not shown) of adhesive 94, is saturated and moves this adhesive in the trough 32 as the applicator 70 is rotated. The applicator 70 then rises onto the ramp 88, the trough shield 74, and onto the return ramp 86 to its location back in the trough 32 where it continues spreading the adhesive 94. (The applicator 70 also coats the interior of the trough shield 74 as it rotates and traverses about the trough shield 74.) The crank 44 is turned a number of times, for example ten rotations, so as to insure that the trough 32 where the applicator 70 is located is sufficiently coated with the adhesive 94.

As the applicator 70 is rotated, it passes by the spout 98 and just touches the spout 98, thereby providing a wiping action to remove any drips of adhesive 94 which may be present at the spout surface 98. This is to prevent any drips of adhesive from falling from the spout 98 when the support base 16 is subsequently moved.

After the applicator 70 has been rotated a sufficient number of times, the rotation of the crank 44 is stopped, making sure that the applicator 70 is stopped and resting somewhere in the trough shield 74, and the locator lever 40 is moved to remove the locator head 30 from the trough 32, and the support base 16 is moved slightly back from its location. The locator head 30 is then released, to rest against one of the crowns 24 of the pipe 12, and the support base 16 again is longitudinally moved until such time as the locator head 30 rests within one of the troughs 32. The process is then repeated as heretofore described. This process then continues, with both movements of the support base 16 and rotation of the crank 44, until such time as each trough 32 of the corrugated pipe 12 has an adhesive coating therein.

Thus, it can be seen that the above-described invention provides a means for coating only the trough of a corrugated pipe with an adhesive which is particularly applicable for trapping contamination particles in a gas-insulated transmission line.

I claim as my invention:

1. Apparatus for coating selected portions of the troughs of a corrugated pipe with an adhesive comprising:

a support disposed in said pipe;

a reservoir containing said adhesive disposed on said support;

pump means including a spout for supplying said adhesive from said reservoir to a trough of said pipe, said pump means being disposed on said support with said spout being aligned with said trough;

a rotatable applicator supported by said support and contacting said trough, said applicator being sized so as to fit within said trough, said applicator contacting said adhesive in said trough and spreading said adhesive in said trough upon rotation;

means for rotating said applicator;

shield means supported by said support and disposed in the path of rotation of said applicator for preventing said applicator from contacting selected portions of said trough; and locator means disposed on said support for aligning said spout, said applicator, and said shield means with said trough.

2. The apparatus according to claim 1 wherein said locator means comprises a pivotally mounted locating head shaped to fit longitudinally within a trough and being biased against said corrugated pipe, said locating head being disposed within a pipe trough when said spout, said applicator, and said shield means are aligned with a pipe trough.

3. The apparatus according to claim 2 wherein said locating head is made of polyethylene.

4. The apparatus according to claim 1 wherein said support comprises a support base and a longitudinally extending support extension connected to said support base, said support base being disposed within said pipe and said support extension extending longitudinally outward from said pipe.

5. The apparatus according to claim 4 wherein said support base includes a low-friction slide in contact with said pipe corrugations.

6. The apparatus according to claim 1 wherein said shield means is disposed in the upper 240° circumferential arc of said pipe trough.

7. The apparatus according to claim 1 wherein said shield means comprises a circumferentially extending trough shield spaced apart from said corrugated pipe, and a spring-biased ramp disposed at each end of said trough shield in the path of rotation of said applicator, said ramp guiding said applicator from said trough onto said trough shield.

8. The apparatus according to claim 1 wherein said applicator, during each rotation thereof, wipes against said spout to remove any adhesive which may be present at said spout.

9. The apparatus according to claim 1 wherein said applicator has a tapered section contacting said pipe in a trough.

10. The apparatus according to claim 1 wherein said applicator rotating means comprises a rotatable drive shaft supported by said support, a bracket member fixedly secured to said drive shaft, an applicator support pivotally mounted on said bracket member and biased in the direction of said pipe, and applicator holder means fixedly secured to said applicator and said applicator support for connecting said applicator to said applicator support.

* * * * *